US005410395A

United States Patent [19]

Parker et al.

[11] Patent Number: 5,410,395

[45] Date of Patent: Apr. 25, 1995

[54] MEANS FOR CONTROLLING TRILEVEL INTER HOUSING SCOROTRON CHARGING LEVEL

[75] Inventors: Delmer G. Parker; James E. Williams, both of Rochester, N.Y.

[73] Assignee: Xerox Corporation, Stamford, Conn.

[21] Appl. No.: 160,639

[22] Filed: Dec. 2, 1993

[51] Int. Cl.[6] ..... G03G 15/01

[52] U.S. Cl. ..... 355/328; 430/42

[58] Field of Search ..... 355/245, 265, 266, 326 R, 355/328, 208, 246, 214; 430/42, 45

[56] References Cited

U.S. PATENT DOCUMENTS

| | | | |
|---|---|---|---|
| 3,457,900 | 7/1969 | Drexler | 118/637 |
| 3,900,001 | 8/1975 | Fraser et al. | 118/637 |
| 4,078,929 | 3/1978 | Gundlach | 96/1.2 |
| 4,308,821 | 1/1982 | Matsumoto et al. | 118/645 |
| 4,486,089 | 12/1984 | Itaya et al. | 355/3 DD |
| 4,525,447 | 6/1985 | Tanaka et al. | 430/122 |
| 4,562,130 | 12/1985 | Oka | 430/54 |
| 4,660,961 | 4/1987 | Kuramoto et al. | 355/4 |
| 4,833,504 | 5/1989 | Parker et al. | 355/326 |
| 4,868,611 | 9/1989 | Germain | 355/328 |
| 5,061,969 | 10/1991 | Parker et al. | 355/328 |

*Primary Examiner*—Joan H. Pendegrass

[57] ABSTRACT

In a highlight color imaging method and apparatus, the charging level of a scorotron used for charge neutralizing an already developed image is controlled by using the bias voltage of a second developer housing as a reference voltage for the the grid of the scorotron. The bias voltage applied to the scorotron is offset a predetermined amount from the bias voltage of the second developer housing.

20 Claims, 3 Drawing Sheets

MEANS FOR CONTROLLING TRILEVEL INTER HOUSING SCOROTRON CHARGING LEVEL

BACKGROUND OF THE INVENTION

This invention relates generally to the rendering of latent electrostatic images visible on a charge retentive surface using multiple colors of dry toner or developer supplied by a plurality of developer housings, and more particularly, to controlling the charging level of a scorotron operably positioned between two developer housings.

The tri-level highlight color xerographic process is one method of making single pass, two color images. The basic concept of tri-level xerography is described in U.S. Pat. No. 4,078,929 issued in the name of Gundlach. In this process, the latent image is created by first charging the photoreceptor (p/r) negatively to some initial charge level ($V_o$), and then exposing the p/r to three discrete voltage levels using a Raster Output Scanner (ROS). The two voltages that represent the document information (black and color) are commonly referred to as the Charged Area Development potential ($V_{CAD}$) and the Discharged Area Development potential ($V_{DAD}$). The third voltage represents the white or background potential ($V_{WHITE}$), and corresponds to non-developed areas of a final print. $V_{CAD}$ is generated when the ROS output is minimum (off), and is roughly equal to $V_o$. $V_{DAD}$, on the other hand, is generated when the ROS output is maximum (on full), and is typically equal to the residual potential of the p/r (<100v). $V_{WHITE}$ is generated when the ROS output is approximately at half power, and is typically equal to $V_0/2$.

Once the tri-level latent image is formed, it is then developed by passing it sequentially through or past two independent developer housings, each containing one of the two required developers. In theory, either of these housings can contain either a black or color developer, and either developer (specifically, the toner) can be either positive or negative in charge, as long as the two developers are opposite in polarity.

When the tri-level latent image is moved past the first developer housing, which by way of example is a DAD development system, the $V_{DAD}$ portion of the latent image is developed with one of the two toners. As development takes place, $V_{DAD}$ is changed in amplitude by a process called charge neutralization, which is the pairing of charges on the p/r with opposite polarity charges on the toner particles. In theory, total neutralization (100%) of $V_{DAD}$ is achieved when enough toner is deposited on the p/r to make the potential of the developed $V_{DAD}$ regions $= V_{DAD}$ bias. In practice, however, total neutralization is rarely achieved, and the Post Development (PD) $V_{DAD}$ voltage is typically 30 volts less negative then $V_{DAD}$ bias.

Development biases for the CAD and DAD development housings are typically set ~ 100 volts above, and below $V_{white}$ respectively. Thus, the CAD positive toner at the second development station experiences a cleaning field of 100 volts to the background areas corresponding to $V_{white}$, and because of the incomplete neutralization in the PD $V_{dad}$, a larger cleaning field of 230 volts in those regions. These cleaning fields, coupled with the weakened magnetics (almost field free) employed in the second housing to minimize the disturbance of the developed DAD image, have the following undesired effects:

1. Because the CAD carrier beads are negative in charge, they are attracted to the more positive regions on the p/r surface. The most positive areas on the p/r prior to entering the second housing are the DAD (PD) areas, and as a result are the areas most likely to suffer deposition of CAD developer beads. The presence of beads in these regions results in large deletions in the DAD image when the image is transferred to paper.
2. Because of the weak magnetics used in the second housing, the effective conductivity of the CAD developer is lower than it would be if it were in the first housing [which uses full strength (i.e. conventional magnetic brush development magnetics)]. As a result, the CAD developer is more likely to respond to fringe fields, such as the ones that exist between $V_{DAD}$ (PD) and $V_{WHITE}$, causing black toner to be deposited around the outside of the DAD or color image areas. This type of deposition has been observed in the past on actual tri-level prints.
3. Any wrong sign toner (negative) contained in the CAD developer will be attracted to, and possibly deposited in, the residual $V_{DAD}$ areas. While this may not be detrimental if the CAD developer is color toner because relatively small amounts of red toner in the black toner are not readily seen, it is very undesirable if the CAD developer is black.

Various techniques have been employed in the prior art to minimize the disturbance of the first developed image by developer materials in the another housing through which the developed image must pass. By in large such techniques have dealt with the modification of the development apparatus of the second developer system. For example:

There is disclosed in U.S. Pat. No. 4,308,821 granted on Jan. 5, 1982 to Matsumoto, et al, an electrophotographic development method and apparatus using two magnetic brushes for developing two-color images which do not disturb or destroy a first developed image during a second development process. This is because a second magnetic brush contacts the surface of a latent electrostatic image bearing member more lightly than a first magnetic brush and the toner scraping force of the second magnetic brush is reduced in comparison with that of the first magnetic brush by setting the magnetic flux density on a second non-magnetic sleeve with an internally disposed magnet smaller than the magnetic flux density on a first magnetic sleeve, or by adjusting the distance between the second non-magnetic sleeve and the surface of the latent electrostatic image bearing members. Further, by employing toners with different quantity of electric charge, high quality two-color images are obtained.

U.S. Pat. No. 3,457,900 discloses the use of a single magnetic brush for feeding developer into a cavity formed by the brush and an electrostatic image bearing surface faster than it is discharged thereby creating a roll-back of developer which is effective in toning an image. The magnetic brush is adapted to feed faster than it discharges by placement of strong magnets in a feed portion of the brush and weak magnets in a discharge portion of the brush.

U.S. Pat. No. 3,900,001 discloses an electrostatographic developing apparatus utilized in connection with the development of conventional xerographic images. It is utilized for applying developer material to a developer receiving surface in conformity with an electrostatic charge pattern wherein the developer is transported from the developer supply to a development zone while in a magnetic brush configuration and thereafter, transported through the development zone in magnetically unconstrained blanket contact with the developer receiving surface.

U.S. Pat. No. 4,833,504 granted to Parker et al on May 23, 1989 discloses a magnetic brush developer apparatus comprising a plurality of developer housings each including a plurality of magnetic rolls associated therewith. The magnetic rolls disposed in a second developer housing are constructed such that the radial component of the magnetic force field produces a magnetically free development zone intermediate a charge retentive surface and the magnetic rolls. The developer is moved through the zone magnetically unconstrained and, therefore, subjects the image developed by the first developer housing to minimal disturbance. Also, the developer is transported from one magnetic roll to the next. This apparatus provides an efficient means for developing the complimentary half of a tri-level latent image while at the same time allowing the already developed first half to pass through the second housing with minimum image disturbance.

It is known in the prior art to expose the charge retentive surface containing a developed image to corona discharge. As illustrated in U.S. Pat. No. 4,660,961 granted to Kuramoto et al on Apr. 28, 1987, a charging assembly is employed between two developer housings for providing additional uniform positive charge to the photosensitive surface used therein.

U.S. Pat. No. 4,562,130 granted to Tateki on Dec. 31, 1985 discloses the use of a scorotron device which is utilized for stabilizing an unstable intermediate potential on a charge retentive surface for the purpose of enabling the setting of developer bias voltages. The unstable potential area is raised to the grid voltage of the scorotron by exposure of the charge retentive surface to the scorotron discharges. The use of such a scorotron device is also disclosed in U.S. Pat. Nos. 4,525,447 granted to Tanaka on Jun. 25, 1985 and 4,539,2181 granted to Tanaka on Sep. 3, 1985.

U.S. Pat. No. 4,308,821 granted to Matsumoto et al on Jan. 5, 1982 disclose the differential charging of developer material in order to obviate materials interaction due to the stronger attractive forces of the one material and the charge retentive surface.

As disclosed in U.S. Pat. No. 4,486,089 granted on Dec. 4, 1984 to Itaya, et. al. a magnetic brush developing apparatus for a xerographic copying machine or electrostatic recording machine has a sleeve in which a plurality of magnetic pieces are arranged in alternating polarity. Each piece has a shape which produces two or more magnetic peaks. The sleeve and the magnets are rotated in opposite directions. As a result of the above, it is alleged that a soft developer body is obtained, and density unevenness or stripping of the image is avoided.

U.S. Pat. No. 4,868,611 granted to Richard P. Germain on Sep. 19, 1989 describes how a scorotron charging device, positioned between the first and second developer housings in a single pass, highlight color, tri-level xerographic system, can be used as a countermeasure against spurious induction development and carrier BCO occurring at the second development housing. The function of the scorotron is to raise the neutralization of a first developed image such that the potential difference between the neutralized image and the second developer housing bias voltage is below the threshold for the onset of BCO.

BRIEF SUMMARY OF THE INVENTION

According to the present invention, a scorotron, disposed intermediate a pair of developer housings in a tri-level imaging apparatus, serves to charge neutralize images developed by the first housing in order to reduce the interactions of the developer materials with the photoreceptor.

Because the xerographic process control system modifies the tri-level electrostatics and developer biases from time to time to compensate for photoreceptor fatigue and vagaries in the xerographic process, the scorotron grid voltage must also be changed to avoid under or over, charging of the first image.

To this end, the scorotron screen potential of a scorotron of the type disclosed in the '611 patent is regulated by using the second development housing bias voltage as a reference. By way of example, the programmable power source providing the scorotron screen voltage could be offset 200 volts from the second development housing bias potential using the control signal to the second development housing bias supply as a reference. Thus, when the bias applied to the second developer housing is adjusted the screen voltage of the scorotron-automatically follows.

It should be understood that the control scheme proposed here is not limited to scorotrons. Any field sensitive DC charging device could be used, in which case, either the coronode voltage, or the shield voltage could be controlled to obtain the desired charging behavior using the second development housing bias voltage as a reference.

DETAILED DESCRIPTION OF THE PREFERRED EMBODIMENT OF THE INVENTION

Figure 4:
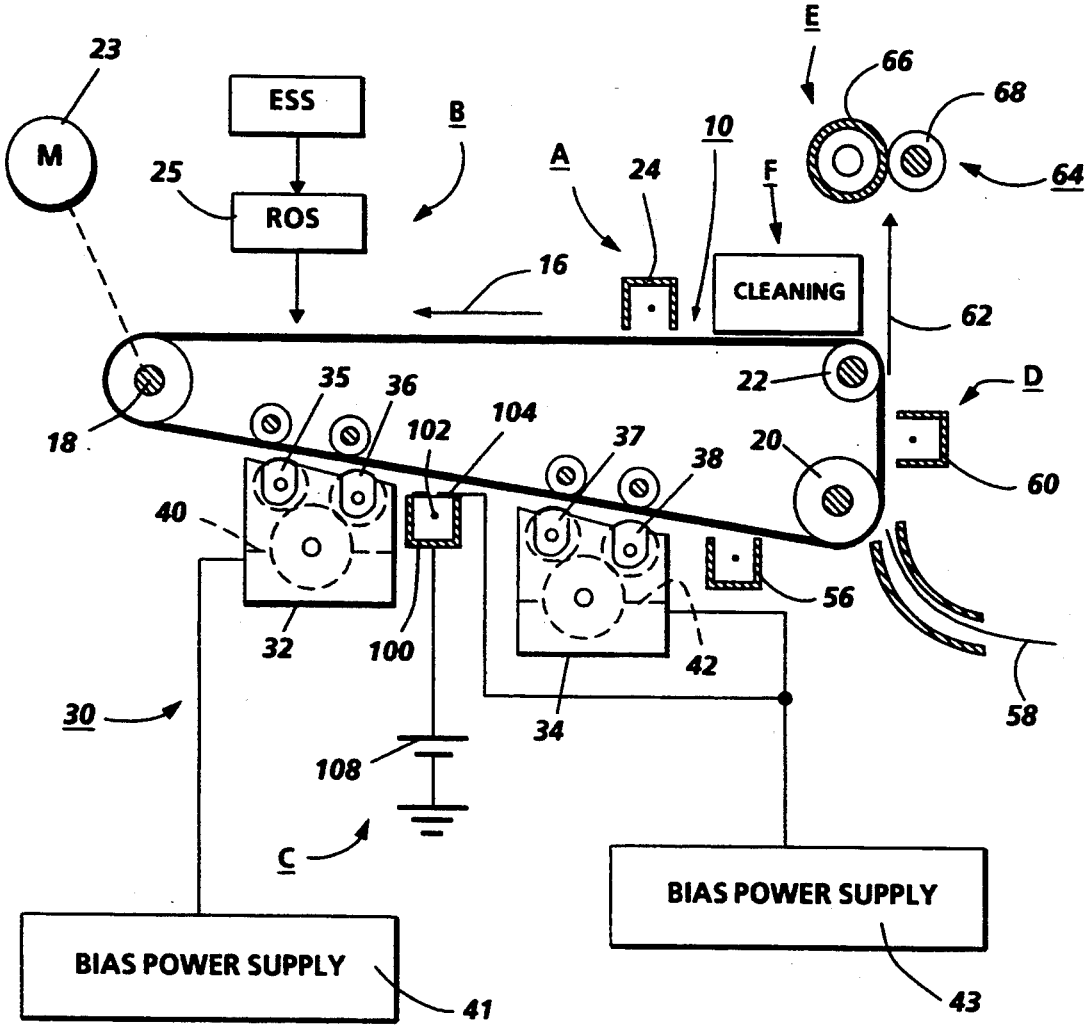
FIG. 4 is a schematic illustration of a tri-level imaging apparatus.

As shown in FIG. 4, a printing machine incorporating the present invention may utilize a charge retentive member in the form of a photoconductive or photoreceptor belt 10 consisting of a photoconductive surface and an electrically conductive substrate mounted for movement past a charging station A, an exposure B, developer stations C, transfer station D and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used as a drive roller and the latter of which can be used to provide suitable tensioning of the photoreceptor belt 10. Motor 23 rotates roller 18 to advance belt 10 in the direction of arrow 16. Roller 18 is coupled to motor 23 by suitable means such as a belt drive.

As can be seen by further reference to FIG. 4 initially successive portions of belt 10 pass through charging station A. At charging station A, a corona discharge device such as a scotorton, corotron or dicorotron indicated generally by the reference numeral 24, charges the belt 10 to a selectively high uniform positive or negative potential, V0. Preferably charging is negative. Any suitable control, well known in the art, may be employed for controlling the corona discharge device 24.

Next, the charged portions of the photoreceptor surface are advanced through exposure station B. At exposure station B, The uniformly charged photoreceptor or charge retentive surface 10 is exposed by a laser based output scanning device 25 which causes the charge retentive surface to be discharged in accordance with the output from the scanning device. Preferably the scanning device is a three level laser Raster Output Scanner (ROS). Alternatively, the ROS could be replaced by a conventional xerographic exposure device.

The photoreceptor, which is initially charged to a voltage $V_0$, undergoes dark decay to a level $V_{ddp}$. When exposed at the exposure station B it is discharged to $V_w$ ($V_{white}$) imagewise in the background image areas, to $V_{CAD}$ which is at or near $V_{ddp}$ in the black area and to $V_{DAD}$ which is near zero or ground potential in the highlight (i.e. color other than black) color parts of the image.

At development station C, a magnetic brush development system, indicated generally by the reference numeral 30 moves developer materials into contact with the electrostatic latent images. The development system 30 comprises first and second developer housings 32 and 34. Preferably, each magnetic brush development housing includes a pair of magnetic brush developer rollers. Thus, the housing 32 contains a pair of rollers 35, 36 while the housing 34 contains a pair of magnetic brush rollers 37, 38. Each pair of rollers advances its respective developer material into contact with the latent image. Appropriate developer biasing is accomplished via power supplies 41 and 43 electrically connected to respective developer housings 32 and 34.

Color discrimination in the development of the electrostatic latent image is achieved by passing the photoreceptor past the two developer housings 32 and 34 in a single pass with the magnetic brush rolls 35, 36, 37 and 38 electrically biased to voltages which are offset from the background voltage $V_w$, the direction of offset depending on the polarity of toner in the housing. One housing e.g. 32 (for the sake of illustration, the first) contains developer with color toner 40 having triboelectric properties such that the toner is driven to the lowest charged ($V_{DAD}$) areas of the latent image by the electrostatic field (development field) between the photoreceptor and the development rolls biased at $V_{Color}$ Bias. Conversely, the triboelectric charge on black toner 42 in the second housing is chosen so that the toner is urged towards parts of the latent image at $V_{CAD}$ or $V_0$ by the electrostatic field (development field) existing between the photoreceptor and the development rolls in the second housing at bias voltages $V_{CAD}$ Bias.

A sheet of support material 58 is moved into contact with the toner image at transfer station D. The sheet of support material is advanced to transfer station D by conventional sheet feeding apparatus, not shown. Preferably, the sheet feeding apparatus includes a feed roll contacting the uppermost sheet of a stack of copy sheets. Feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station D.

Because the composite image developed on the photoreceptor consists of both positive and negative toner, a pre-transfer corona discharge member 56 is provided to condition the toner for effective transfer to a substrate using corona discharge.

Transfer station D includes a corona generating device 60 which sprays ions of a suitable polarity onto the backside of sheet 58. This attracts the charged toner powder images from the belt 10 to sheet 58. After transfer, the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 58. Preferably, fuser assembly 64 comprises a heated fuser roller 66 and a backup roller 68. Sheet 58 passes between fuser roller 66 and backup roller 68 with the toner powder image contacting fuser roller 66. In this manner, the toner powder image is permanently affixed to sheet 58. After fusing, a chute, not shown, guides the advancing sheet 58 to a catch tray, also not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station F.

Subsequent to cleaning, a discharge lamp (not shown) floods the photoconductive surface with light to dissipate any residual electrostatic charge remaining prior to the charging thereof for the successive imaging cycle.

Figure 1:
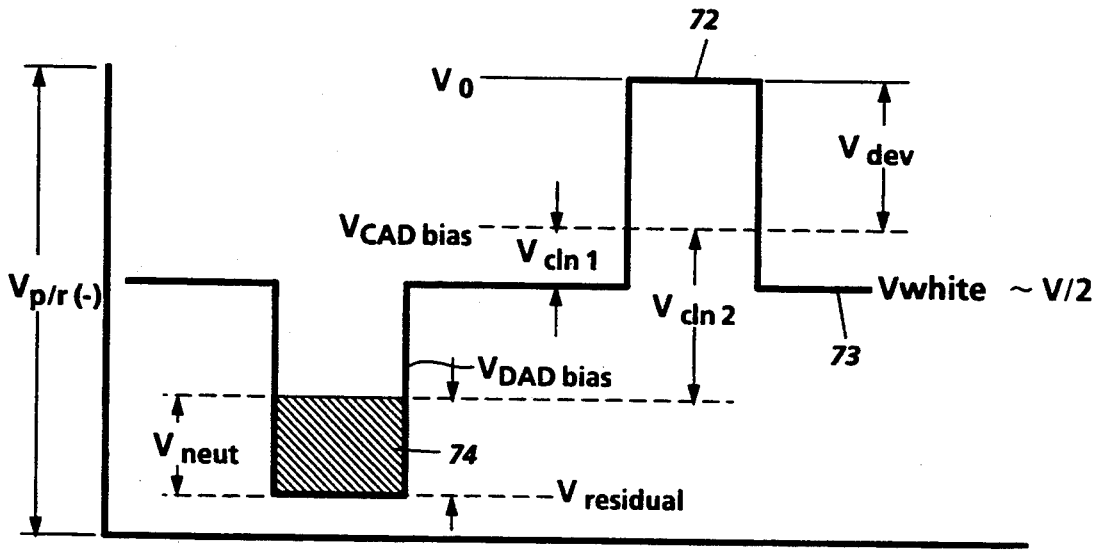
FIG. 1 is a plot of photoreceptor potential illustrating singlepass, highlight color latent image characteristics following development of one of the tri-level images.

FIG. 1 depicts the photoreceptor voltage profile of a tri-level electrostatic image after the discharged area portion of the composite image has been Discharged Area Developed (DAD) using the first development housing 32 containing negative color toner and positively charged carrier particles. As indicated by the shaded area 74, the potential of the DAD image has been elevated above $V_{residual}$ by an amount $=V_{neut}$ due to the toner charge on the developed DAD image.

Charged areas ($V_0$), 72 of the photoreceptor will be Charged Area Developed (CAD) by the second development housing 34 using the development field created by the potential difference ($V_{dev}$) between highly charged areas of the photoreceptor areas ($V_0$), and the second developer bias voltage $V_{Cad\ bias}$. Toner in the second development housing is repelled from the tri-level image's background region 73, ($V_{white}$) by cleaning field $V_{cln1}$ which has a magnitude ($V_{CAD\ bias}-V_{white}$) and is about 100 volts. However, black toner in the second development housing 34 experiences a much larger cleaning field, $V_{cln2}$ in regions 74 of the composite tri-level image that have been previously developed by the color toner. The magnitude of $V_{cln2}$ is $[V_{CAD\ bias}-(V_{neut}+V_{residual})]$. In a tri-level system, such as that used in the 4850 printer, that employs Conductive Magnetic Brush (CMB) developers, the $V_{neut}$ level is about the same as the $V_{dad\ bias}$ voltage on the first development housing (approximately 100 volts less the $V_{white}$).

Hence, $V_{cln2}$ is equal to ($V_{cad\ bias}-V_{dad\ bias}$) and is on the order of 200 volts.

Although $V_{cln2}$ is a cleaning field for the second housing CAD developer, it is a development field for developed DAD toner, and thus the DAD image tends to be held in place, thereby resisting scavenging by the CAD developer. $V_{cln2}$ is also a development field for the negatively charged carrier beads in the second housing and therefore promotes Bead CarryOut (BCO) that can cause tent transfer deletions. In a conventional magnetic brush development system, the cleaning field is typically 100 volts, and BCO is easily managed by the magnetic affinity of the carrier beads for the development roll magnets. This is not the case at the second development station in a tri-level system where, as it was pointed out above, the cleaning fields above the DAD image are in the neighborhood of 200 volts. Furthermore, tri-level xerography requires that the second development employ low force magnetics in the development zone (soft brush) to avoid smearing the portions of the composite image that have been previously developed at the first development station. The combination of low force magnetics and high cleaning fields tends to create a BCO control problem.

Figure 2:
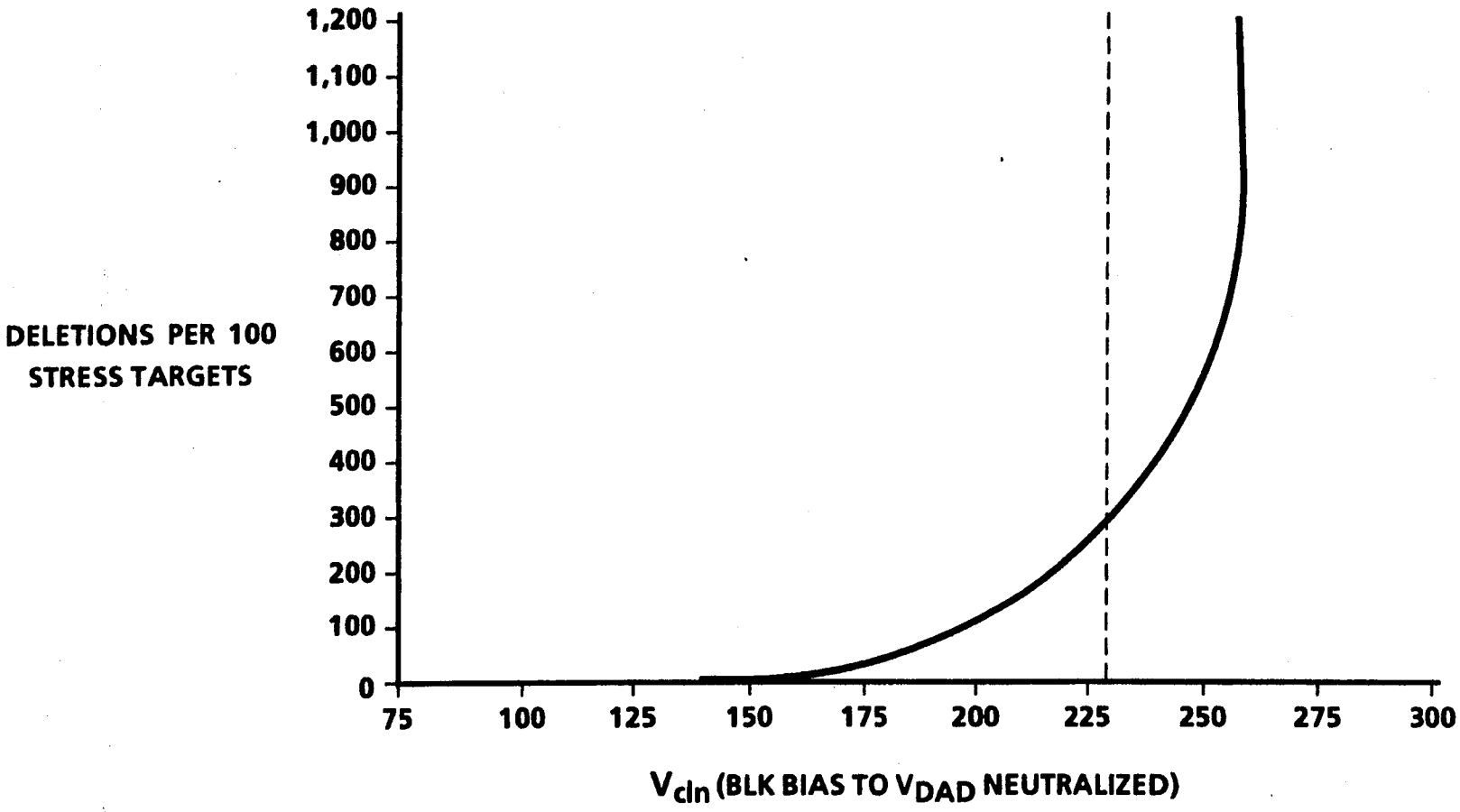
FIG. 2 depicts the bead carry out (BCO) rate for a stress target as a function of the difference between the second development housing bias voltage and the developed first image (neutralized) voltage.

Tent deletions resulting from BCO can be a major problem if appropriate countermeasures are not taken. A glance at FIG. 2 illustrates why BCO is a major problem in tri-level xerography. FIG. 2 shows the BCO rate for a stress target as a function of the difference between the second development housing bias voltage and the developed first image (neutralized) voltage. Note the sharp increase in BCO rate as this difference ($V_{cln2}$ as defined earlier) exceeds 230 volts (denoted by the vertical broken line). The BCO rates shown in FIG. 2 for $V_{cln2}$ voltages greater than 230 are generally considered unacceptable.

Clearly, the best strategy for controlling tri-level BCO is one that insures that $V_{cln2}$ does not exceed 200 volts, but one that does not unduly restrict the magnitude of the background cleaning fields that can be employed at the first and second development housings.

The magnetic brush rolls 35 and 36 may comprise any conventional structures known in the art that provide a magnetic field that forms the developer material in the housing 32 into a brush-like configuration in the development zone between the rolls 35 and 36 and the charge retentive surface. This arrangement effects development of one of the two image areas contained on the charge retentive surface in a well known manner.

The magnetic brush rolls 37 and 38 on the other hand are constructed such that development of the other of the two image areas is accomplished with minimal disturbance of the first image. To this end, the magnetic rolls 37 and 38 comprise magnetic force fields as disclosed in U.S. Pat. No. 4,833,504. As shown therein, the radial force profiles of the these two rolls are such as to cause developer to be picked up from the developer housing 34 and conveyed to the top of the roll 37 where the developer becomes magnetically unconstrained. The developer is moved through the development zone in a magnetically unconstrained manner until it is attracted to the roll 38 due to the radial magnetic forces of that roll. As will be appreciated, the rolls 35 and 36 may be fabricated in the same manner as the rolls 37 and 38. Such a construction of rolls 35 and 36 would render them less likely to disturb the latent image which is subsequently developed by the rolls 37 and 38.

To further minimize the interaction of developer materials in the housing 34 with the DAD residual image, there is provided a corona discharge device in the form of a scorotron comprising a shield 100, one or more coronode wires 102 and a conductive grid 104. A suitable scorotron, as disclosed in U.S. Pat. No. 4,591,713, comprises a corona generating electrode of short radius, an insulating and partially open shield, partially housing the electrode, a source of electrical potential being operatively connected to the electrode to cause the electrode to emit a corona discharge, the coronode being separated from a screen by 4 to 5 mm. The conductive control grid (screen) is spaced about 1.5 to 2 mm away from the surface to be charged. Impedance to the electrode (coronode) is provided to prevent arcing. The resistance is selected to provide about a 10% drop in potential from the power supply to the electrode.

Figure 3:
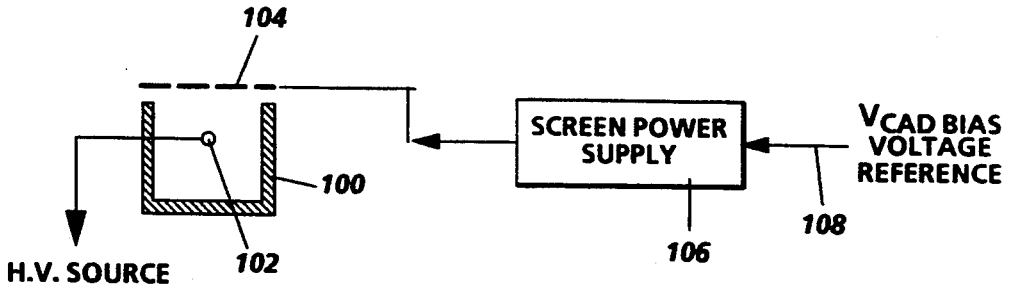
FIG. 3 is a schematic illustration of a scorotron and control for the scorotron.

According to the present invention, the charge level of the toned residual image [$V_{DAD}$(PD)] is automatically adjusted by the correct amount in response to changes in the bias applied to the developer housing 34. To this end, the bias applied to the developer housing 34 is used as a reference for applying power to the scorotron screen 104 (FIG. 3). The bias applied to the screen is actually offset 200 volts from the developer housing bias. As will be appreciated, the developer housing 34 bias may also be varied in order to effect the deposition of more or less toner on a particular image. Such changes in developer biases will be automatically reflected in the the scorotron screen bias. Also, the grid bias may be modified in response to changes in the charging voltage as well as changes in the ROS output.

While the foregoing description was made with respect to a tri-level system where the DAD developer is contained in the first housing and CAD developer is contained in the second housing it is contemplated that image charge neutralization as discussed above will also work for the case where the CAD developer resides in the first developer housing and the DAD developer is in the second housing. The only change required to the scorotron would be to apply a positive voltage to the coronode wires in order to produce a positive corona. In this case, the scorotron control grid would be set ~200 volts more negative than the $V_{dad\ bias}$ potential so that no negative current would flow from the scorotron to the $V_{White}$ or $V_{dad}$ regions of the p/r, because they are positive with respect to the control grid.

We claim:

1. Highlight color imaging apparatus, said apparatus comprising;

a charge retentive surface;

means for uniformly charging said charge retentive surface to different charge levels;

means for discharging said uniformly charged surface to different charge levels for forming a single polarity charge pattern having at least three different voltage levels on a charge retentive surface wherein two of the voltage levels correspond to two image areas and the third voltage level corresponds to a background area means including a first developer housing containing developer materials for forming a first contrasting image in one of said two image areas, said means including means for electrically biasing said first developer housing to different voltage levels;

means including a second developer housing containing developer materials for forming a second contrasting image in the other of said two image areas, said means including means for electrically biasing said second developer housing to different voltage levels; and means responsive to a change in one of said levels for substantially precluding the interaction of developer material in said second housing with said charge retentive surface.

2. Apparatus according to claim 1 where in said means responsive to a change comprises means responsive to a change in one of said developer housing biases.

3. Apparatus according to claim 2 wherein said one of said developer housing biases comprises the bias applied to said second developer housing.

4. Apparatus according to claim 3 wherein said means responsive to a change comprises a field sensitive DC charging device.

5. Apparatus according to claim 4 wherein said field sensitive device comprises a scorotron.

6. Apparatus according to claim 5 wherein said means responsive to a change comprises the grid of said scorotron.

7. Apparatus according to claim 6 including means for applying the electrical bias applied to said second developer housing, offset by a predetermined amount.

8. Apparatus according to claim 7 wherein said predetermined amount is approximately 200 volts.

9. Apparatus according to claim 1 wherein said precluding means comprises means for modifying the charge level of said first contrasting image prior to its movement past said second developer housing.

10. Apparatus according to claim 9 where in said means responsive to a change comprises means responsive to a change in one of said developer housing biases.

11. Apparatus according to claim 10 wherein said one of said developer housing biases comprises the bias applied to said second developer housing.

12. Apparatus according to claim 11 wherein said means responsive to a change comprises a field sensitive DC charging device.

13. Apparatus according to claim 12 wherein said field sensitive device comprises a scorotron.

14. Apparatus according to claim 13 wherein said means responsive to a change comprises the grid of said scorotron.

15. Apparatus according to claim 14 including means for applying the electrical bias applied to said second developer housing, offset by a predetermined amount.

16. A method of creating highlight color images including the steps of:

uniformly charging a charge retentive surface to different voltage levels;

discharging said uniformly charged surface to different voltage levels for forming a single polarity charge pattern having at least three different voltage levels on a charge retentive surface wherein two of the voltage levels correspond to two image areas and the third voltage level corresponds to a background area using a first developer housing containing developer materials, forming a first contrasting image in one of said two image areas electrically biasing said first developer housing to different voltage levels;

using a second developer housing containing developer materials, forming a second contrasting image in the other of said two image areas and electrically biasing said second developer housing to different voltage levels; and in responsive to a change in one of said levels, substantially precluding the interaction of developer material in said second housing with said charge retentive surface.

17. The method according to claim 16 wherein said means responsive to a change comprises the grid of said scorotron.

18. The method according to claim 17 including means for applying the electrical bias applied to said second developer housing, offset by a predetermined amount.

19. The method according to claim 18 wherein said predetermined amount is approximately 200 volts.

20. The method according to claim 19 where in said means responsive to a change comprises means responsive to a change in said second developer housing bias.

* * * * *